United States Patent [19]

Drane et al.

[11] Patent Number: 4,805,541

[45] Date of Patent: Feb. 21, 1989

[54] TABLETOP CONSTRUCTION

[75] Inventors: Mark R. Drane, Memphis; Jerry E. Johnson, Grand Junction; Samuel L. Ragusa, Germantown, all of Tenn.

[73] Assignee: Hart/Troxel Joint Venture, Moscow, Tenn.

[21] Appl. No.: 35,160

[22] Filed: Apr. 6, 1987

[51] Int. Cl.[4] ..... A47B 17/00

[52] U.S. Cl. ..... 108/27; 108/157

[58] Field of Search ..... 108/27, 157, 155, 153; 312/137, 140.4; 52/821, 813, 822, 823; 49/462

[56] References Cited

U.S. PATENT DOCUMENTS

| | | | |
|---|---|---|---|
| D. 142,211 | 8/1945 | Glukes | 108/157 X |
| 900,247 | 10/1908 | Williams . | |
| 2,644,733 | 7/1953 | Castle | 311/107 |
| 2,729,279 | 1/1956 | Axtell et al. | 108/157 X |
| 3,074,771 | 1/1963 | Wilson | 108/157 X |
| 3,366,079 | 1/1968 | Koransky et al. | 108/157 |
| 3,545,625 | 10/1970 | MacMillan | 211/148 |
| 3,561,376 | 2/1971 | Knoblock | 108/157 X |
| 3,643,608 | 2/1972 | DeCesars | 108/157 |
| 3,811,673 | 5/1974 | Baker | 108/27 X |
| 3,912,085 | 10/1975 | Cooke et al. | 108/27 X |
| 3,958,517 | 5/1976 | Jay | 108/159 |
| 3,968,606 | 7/1976 | Facemire | 52/127 |
| 4,003,320 | 1/1977 | Owens et al. | 108/157 |
| 4,315,467 | 2/1982 | Vanderminden | 108/157 |
| 4,467,730 | 8/1984 | Borichevsky | 108/159 |
| 4,503,780 | 3/1985 | Apissomian | 108/27 |
| 4,535,756 | 8/1985 | Rinehart et al. | 52/823 X |

FOREIGN PATENT DOCUMENTS

| | | | |
|---|---|---|---|
| 524105 | 7/1940 | United Kingdom | 108/27 |

*Primary Examiner*—Kenneth J. Dorner
*Assistant Examiner*—Jose V. Chen
*Attorney, Agent, or Firm*—Luedeka, Hodges & Neely

[57] ABSTRACT

A table top construction including a frame and a top plate with a rim bounding the marginal edge of the plate. An upper, inwardly extending flange of the rim rests on the upper surface of the plate and a lower, inwardly extending flange is spaced below the upper flange. Wedge members are inserted in the rim between the flanges to maintain the top plate against the upper flange. Connecting members engage the wedge members and the frame to prevent relative movement between the frame and the rim.

12 Claims, 2 Drawing Sheets

TABLETOP CONSTRUCTION

The present invention relates to tables and more particularly relates to a simple and economical means for securing the tabletop to the supporting frame structure.

Conventional tables include a top and a supporting frame structure of some kind on which the top rests. It is usually economically advantageous to ship the tables in a disassembled form. For example, the tops are typically separated from the frames during shipment to save space. Also, the tops are often glass and the like and breakage is minimized by separating the tops from the frames and storing the tops in cushioned containers.

Thus, while it is usually advantageous to ship the tables in disassembled form, it is desirable to minimize the extent of disassembly and the number and complexity of parts required to assemble the table upon receipt. One reason for this is that retail merchants and ultimate consumers generally view assembly of the tables as a nuisance. Also, the usual practice of including a parts bag containing nuts, bolts, screws, etc., adds a significant expense to the ultimate cost of the tables since the parts must be inventoried, packaged, and handled separately from the other components of the tables. Although intended as an accommodation to the customer, this practice occasionally backfires when one or more of the parts needed are omitted from the parts bag which is intensely irritating to the customer and reflects adversely on the manufacturer. In view of the above and other problems, it would be advantageous to provide a table which can be quickly and easily assembled following shipment without resort to any extra parts.

It is also desirable in table design to provide a decorative arrangement so that unsightly construction details and interconnections are either avoided altogether, or are substantially hidden from view. In this regard, it has been a prime concern of designers to minimize or avoid the use of nuts, bolts, etc. to connect the components together and to hide any such connectors that may be required.

Accordingly, it is an object of this invention to provide a table which can be shipped in a knockdown condition and readily assembled upon receipt.

It is another object of the invention to provide a table of the character described wherein the parts required for assembly may be incorporated into the knockdown components in advance of shipment eliminating the need to include the parts separately along with the other items shipped.

A further object of the invention is the provision in a table assembly of a simple and convenient connection between the tabletop and its supporting frame structure wherein the construction details are substantially hidden from view to the casual observer.

The above and other objects and advantages of the invention will be better understood from the following detailed description when considered in conjunction with the accompanying drawings in which.

Figure 2:
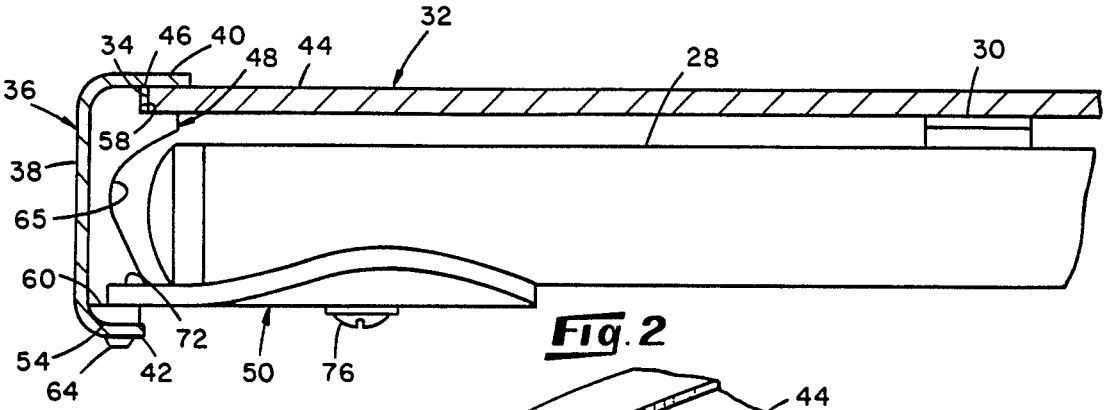
FIG. 2 is a fragmentary side view, partially in section, illustrating a wedge member supporting a top plate of the table in a rim and a bracket for connecting the wedge member and rim to a supporting frame structure.
Figure 3:
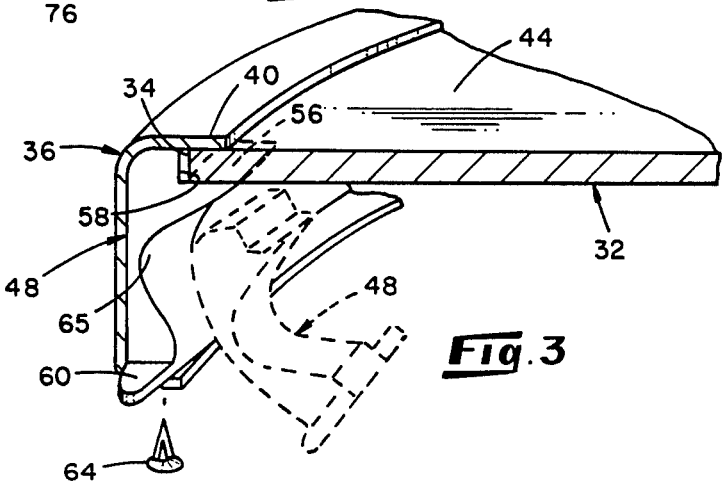
FIG. 3 is a fragmentary perspective view, partially in section, illustrating a manner of positioning the wedge member in the rim to hold the top plate in place.
Figure 4C:
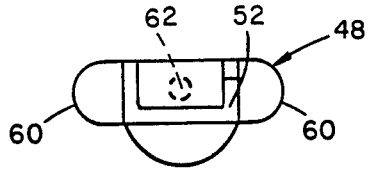
Figure 4A:
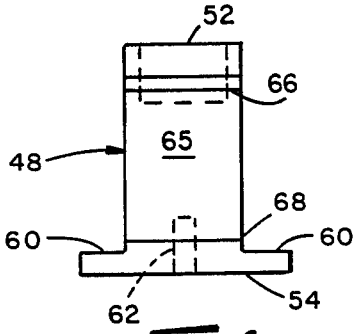
Figure 4B:
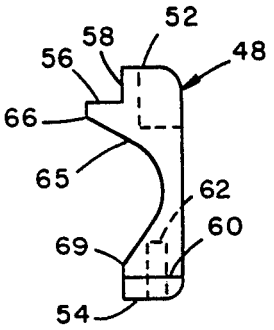
Figure 4D:
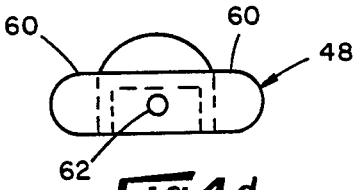
Figure 5A:
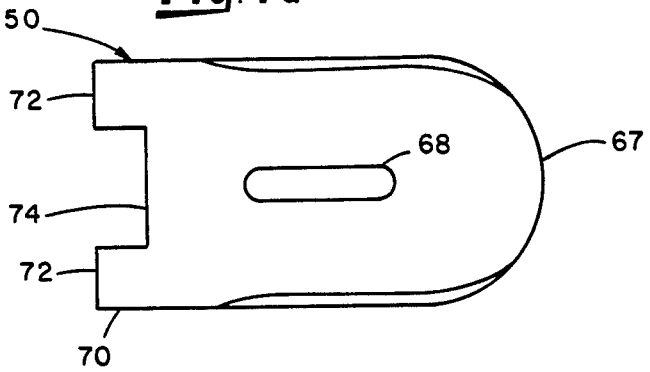
Figure 5B:
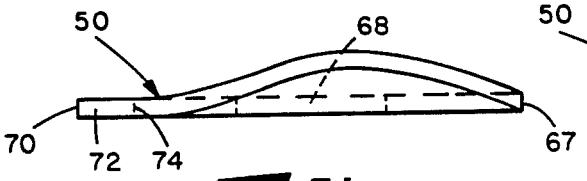
Figure 5C:
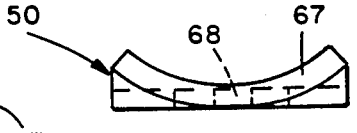

FIGS. 4*a* through 4*d* are front, side, top, and bottom views of the wedge member illustrated in FIGS. 2 and 3; and FIGS. 5*a* through 5*c* are top, side, and end views of the bracket illustrated in FIG. 2.

In general, the invention includes a table comprising a frame structure and a top plate supported on the frame. A rim bounds the marginal edge of the top. The rim includes an upper flange which extends inwardly towards the center of the top plate and is configured to overlay at least a portion of the upper surface of the plate. A lower flange of the rim extends inwardly towards the center of the top plate and is spaced below the upper flange. A plurality of wedge members are disposed between the top plate and the lower flange and are configured to maintain the top plate in a fixed position adjacent the upper flange. Connecting members are provided which are configured to interengage each of the wedge members and the frame to prevent relative movement between the frame and the rim.

The wedge members are preferably configured to be fitted into the rim and fixed to the lower flange of the rim prior to shipment of the table assembly so that the top plate and rim can be shipped together in their fully assembled form. The connectors are releasably fastened to the frame, also prior to shipment, and are configured to be released and positioned to engage the wedge members in the frame following shipment when the table is ready to be assembled. Thus, no extra parts are needed to assemble the table following shipment. Assembly is accomplished very quickly and with a minimum of inconvenience simply by placing the previously assembled top plate and rim on the frame and positioning the connectors to interengage the wedge members and the frame.

Referring now to the drawings in which like reference characters refer to like or similar parts throughout the several views, features of a table 20 are shown illustrating a preferred embodiment of the present invention. The embodiment of the invention illustrated is in the form of a patio table which is a type of table that is particularly well suited for utilization of the invention. However, it is contemplated that the invention will be useful in other types of tables, and is not to be construed as limited solely for use in a patio table construction.

Figure 1:
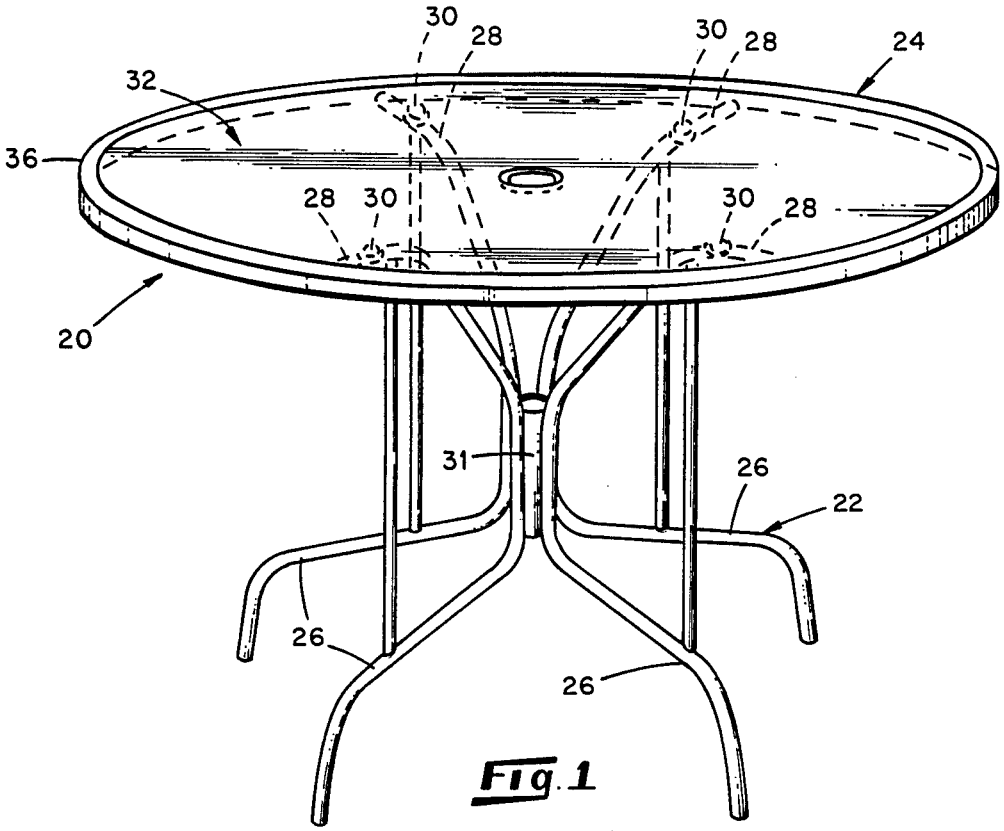
FIG. 1 is a front perspective view of a table assembly illustrating features of the present invention.

Referring first to FIG. 1, the table 20 includes a frame structure 22 which supports a horizontally disposed tabletop structure 24. In the type of table shown, the frame 22 includes a plurality of legs 26, in this case four, that are substantially equally spaced from one another about the vertical center axis of the table 20. The upper ends of the legs 26 diverge from adjacent legs and include substantially horizontally disposed sections 28. Plastic or rubber bushings 30 are mounted on the upper surfaces of the sections 28 and support the top 24 on the frame 22. The legs 26 may be suitably provided by steel tubing which is bent to obtain the desired configuration and may be connected together by welding the same to a vertically disposed cylinder 31 which doubles as an umbrella pole holder.

The top structure 24 in the embodiment shown is of an oval configuration, although it is understood that the top 24 may be round, square, or square with rounded corners, as desired. The planar surface of the top 24 may include, for example, a plate 32 of tempered glass having a decorative hammered finish with an outer marginal edge 34. A rim 36 bounds the marginal edge 34 of the plate 32.

The rim 36 is preferably continuous and includes a vertically disposed band portion 38 from which upper and lower flanges 40 and 42 extend inwardly at the respective upper and lower ends of the band 38. The rim 36 is shaped to substantially conform to the shape of the edge 34 of the plate 32.

In the preferred embodiment, the edge of the upper flange 40 is spaced from the band 38 by a sufficient amount so that when the top 32 is positioned and centered in the rim 36, the upper flange 40 will overlap the edge 34 around the periphery of the top plate 32. The edge of the lower flange 42 is spaced from the band 38 by a lesser amount than the edge of the upper flange 40, and preferably terminates at a location so that it will be just outside of the peripheral edge 34 of the top plate 32 when the top 32 is centered in the rim 36. The width of the upper and lower flanges 40 and 42 is substantially uniform around the rim 36.

Preferably, the top plate 32 is maintained with its upper surface 44 in contact with the lower surface 46 of the upper flange 40. A preferred means for maintaining this contact is provided by a plurality of substantially uniformly shaped wedge members 48 (only one member 48 is illustrated for clarity) which are placed into the rim 36 between the upper and lower flanges 40 and 42 and configured to maintain the plate 32 against the upper flange 40 as will be subsequently described.

Connected to the lower surface of each of the horizontal sections 28 of the leg members 26 is a connector or bracket 50. The brackets 50 are configured together with the wedge members 48 to securely attach the rim 36 to the frame 22 to prevent relative movement between the rim 36 and frame 22.

The features of a preferred form of the wedge members 48 are illustrated in FIGS. 4*a* through 4*d*. Each member 48 is shaped to substantially conform to the inside shape of the rim 36. The distance between a top surface 52 and a bottom surface 54 of the member 48 is preferably substantially equal to the distance between the inner surfaces of the upper and lower flanges 40 and 42 of the rim 36 to provide an interference fit of the members 48 in the rim 36. A shoulder 56 is formed on the upper end of the member 48 on the side of the member 48 that faces away from the band 38 of the rim 36. The shoulder 56 is in the form of a substantially horizontally disposed planar surface which is spaced below the upper surface 52 of the member 48 by an appropriate distance to insure that the plate 32 will be engaged by the shoulder 56 and maintained against the lower surface of the upper flange 40 when the member 48 is inserted into the rim 36.

A vertically disposed face 58 extends upwardly from the shoulder 56 to the top surface 52. The dimension of the wedge member 48 from the face 58 to the back surface of the member 48 is preferably selected so that the faces 58 are in substantial contact with the marginal edge 34 when the members 48 are disposed between the flanges to maintain the plate 32 against the upper flange 40. This centers the plate 32 in the rim 36 and maintains the edge 34 of the plate 32 at a substantially uniform distance from the band 38 around the periphery of the plate 32 to isolate the edge 34 from contact with the rim 36.

Tabs 60 project from opposite sides of each member 48 at its lower end to interact with the bracket 50 in a manner to be described below. Intermediate the tabs 60 and extending up from the bottom surface 54, a vertically directed opening 62 is provided for receiving the end of a rivet 60 (see FIG. 4*a* through 4*d*) to attach the member 48 to the lower flange 42 of the rim 36.

In the preferred embodiment, the wedge member 48 is articulated to enable its positioning between the flanges 40 and 42 of the rim 36 after the plate 32 has been placed in the rim 36 against the upper flange 40. This is preferably accomplished through the provision of a curvilinear recess 65 in the wedge members 48 extending between edges 66 and 69 and located on the side of the members 48 facing away from the band portion 38 of the rim 36. The recess 65 decreases the thickness of the member 48 adjacent its center area by a sufficient amount to enable deformation of the member 48 in the area of the recess 65 and to enhance the flexibility of the member 48. To this end, the material of construction is preferably resiliently deformable so that it may be deformed in the manner shown in FIG. 3 (see dotted line representation of the member 48) to enable the member 48 to be folded about the recess 65 and placed into the rim 36 with the plate against the top flange 40, and then unfold (see solid line representation of the member 48) in the rim 36 between the flanges 40 and 42. This also provides a cushion between the edge 34 of the top plate 32 and the band 38 of the rim 36. Nylon has been found suitable for constructing the members 48 since it is durable, inexpensive, and can be molded in a resiliently deformable form. Other suitable materials include, for example, high molecular weight polyethylene, polypropylene, and the like.

It should be noted that the wedge member 48 may be provided in numerous other forms in addition to the one previously described. For example, the wedge member 48 may comprise upper and lower sections hinged together adjacent the center area of the wedge member with the sections being formed of a substantially rigid material.

A plurality of openings (not shown) are provided in the lower flange 42 to receive the rivets 64 therethrough for attaching the wedge members 48 to the rim 36. To facilitate proper alignment of the members 48 with the brackets 50 attached to the sections 28 of the legs 26, the openings are spaced to lie substantially on the longitudinal axis of the sections 28 when the top 24 is placed on the frame structure 22 and the top 24 is rotated to position the members 48 adjacent the ends of the sections 28 as shown in FIG. 2.

The plate 32 is preferably located in the rim 36 prior to insertion of the members 48 into rim 36. The plate 32 is concentrically positioned in relation to the rim 36 with its marginal edge 34 located adjacent the upper flange 40 so that the upper surface 44 of the plate 32 is against the lower surface of the upper flange 40. The members 48 are then inserted into the rim 36 at the location of the openings in the lower flange 42 by folding the members 48 and wedging the upper surfaces 52 of the members 48 into the upper inside corner of the rim 36. The shoulders 56 are thus located against the undersurface of the plate 32 which is engaged by the shoulders 56 to maintain the plate 32 against the lower surface of the upper flange 40, and the faces 58 are in substantial contact with the marginal edge 34 of the plate 32. The bottom surfaces 54 of the members 48 are wedged into the lower inside corner of the rim 36 when the members 48 unfold, whereupon the members 48 are frictionally maintained between the upper and lower flanges 40 and 42 of the rim 36. The positions of the members 48 are adjusted if necessary to align the openings 62 with the openings in the lower flange 42.

The rivets 64 are then inserted through the openings in the lower flange 42 and forced into the openings 62 which are appropriately configured to receive the rivets 64 in frictional engagement to hold the members 48 in fixed positions inside the rim 36.

Referring to FIGS. 5*a* through 5*c*, features of the preferred form of the bracket 50 will now be described. A rounded, right-hand end 67 of the bracket 50 as viewed in FIGS. 5*a* and 5*b* conforms to the shape of the sections 28 and thus has a saddle-like configuration when the legs 26 are tubular in configuration. An elongate, longitudinally directed slot 68 is provided in the approximate center of the bracket 50. A forked end 70 of the bracket 50 opposite the rounded end 67 includes forked members 72 spaced apart by the approximate width of the wedge member 48 above the tabs 60 as viewed in FIG. 4*a*. A squared recess 74 is provided between the forked members 72 and preferably extends into the bracket 50 by an amount that is slightly less than the thickness of the lower portion of the wedge member 48.

The brackets 50 are fastened to the sections 28 of the legs 26 by roundhead screws 76 and their associated washers. The screws 76 are threadably received in the lower surface of the sections 28 and extend through the slots 68 in the brackets 50. The brackets 50 are preferably fastened to the sections 28 of the legs 26 prior to shipment of the patio table assembly 20.

When it is desired to secure the top 24 to the frame 22, the screws 76 are loosened and the brackets 50 are moved to position the ends of the slots 68 adjacent the forked end 70 near the screws 76. This provides sufficient room for placement of the previously assembled top 24 and its associated rim 36 down over the ends of the sections 28. The position of the top 24 is adjusted so that the spaces between the ends of the sections 28 and rim 36 are substantially uniform about the circumference of the top 24. Also, the top 24 is positioned so that the wedge members 48 are aligned with the brackets 50. Then, the brackets 50 are moved out on the sections 28 to position their forked ends 70 on the members 48 so that the forked members 72 straddle the members 48, and rest on the upper surface of the tabs 60 of the members 48 as shown in FIG. 2.

The respective dimensions and configurations of the brackets 50, rim 36, and members 48 are selected so that when the screws 76 are tightened with the forked members 72 positioned on the tabs 60, the upper flange 40 of the rim 36 will exert a moderate downward force on the plate 32 causing the plate 32 to bear against the upper surfaces of the bushings 30. The top 24 is therefore firmly secured to the frame structure 22 in a manner which substantially prevents vertical displacement of the top 24 with respect to the frame 22. The plate 32 of the top 24 is also firmly held in the rim 36 by the provision of the wedge members 48 as previously described. Moreover, the above-described interaction between the brackets 50 and the members 48 to effect assembly of the table 20 prevents rotation of the top 24 in relation to the frame 22 due to the straddling of the members 48 by the forked members 72 of the brackets 50. And, since the brackets 50 are moved out against the members 48 at spaced locations around the rim 36 prior to tightening of the screws 76, horizontal displacement of the top 24 in relation to the frame 22 is prevented giving rise to a very stable overall construction of the table assembly 20.

The provision of forked ends 70 on the brackets 50 provides a preferred means by which the brackets 50 are configured to engage the wedge members 48. It should be noted that numerous other configurations may be employed for this purpose. For example, the wedge members 48 can be provided with horizontal openings accessible on the side of the members 48 adjacent the brackets 50, and the brackets 50 provided with projections that are received in the openings of the members 48 to engage them to secure the assembled top 24 to the frame 22 as described.

Among the advantages offered by the previously described embodiment of the present invention is the capability of shipping the table 20 in a knockdown condition comprising only two separate components. That is, the top 24 may be assembled as an independent component prior to shipment by placing the plate 32 in the rim 36 and securing it to the rim 36 by the wedge members 48 as previously described. The frame structure 22 may be produced as an integral whole by welding the legs 26 to the cylinder 31 and the brackets 50 fastened by the screws 76 to the sections 28 of the legs 26 at the factory. The frame structure 22 with the attached brackets 50 can be arranged in a nested relationship for shipment separately from the previously assembled tops 24. This enables efficient shipment of the tables 20 since the storage space required during shipment is less than that required for fully assembled tables. Once the tables 20 reach their final destination and are ready for assembly, the tops 24 may be quickly and easily secured to the frame structures 22 as described above without the need of resorting to extra nuts and bolts since the items needed to effect assembly of the table 20 have been previously included with its two major components. Thus, there are no separate parts bags to provide or keep up with during shipment and assembly, and the possibility that one or more parts needed for assembly might be omitted or lost is substantially eliminated.

Although a preferred embodiment of the present invention has been described in the foregoing detailed description, it will be understood that the invention is capable of numerous rearrangements, modifications and substitutions of parts without departing from the scope and the spirit of the claims as set forth below.

We claim:

1. In a table having a frame and a top plate supported on the frame, the top plate having a marginal edge, the improvement comprising a rim bounding the marginal edge of the top plate and having an upper flange extending inwardly towards the center of the top plate and dimensioned to overlay at least a portion of the top plate and a lower flange spaced below said upper flange and extending inwardly towards the center of the top plate, a plurality of wedge members disposed between said upper and lower flanges of said rim and including means for maintaining the top plate in a fixed position adjacent said upper flange and in spaced relation to said lower flange, and a plurality of connectors configured to interengage said wedge members and said frame to prevent relative movement between said frame and said wedge members.

2. The improvement of claim 1, further comprising means for fixedly connecting said wedge members to said rim.

3. The improvement of claim 1, wherein said upper flange has a lower surface and said means for maintaining maintains the top plate against the lower surface of said upper flange.

4. The improvement of claim 1, wherein said upper flange has a lower surface and said means for maintaining includes a shoulder disposed adjacent said upper flange which is configured to receive the marginal edge of the top plate and maintain the top plate against the lower surface of said upper flange.

5. The improvement of claim 1, wherein said wedge members are deformable to facilitate positioning of said wedge members between said upper and lower flanges of said rim.

6. The improvement of claim 1, wherein said upper and lower flanges have inner edges and said rim is continuous and includes a band portion extending between said upper and lower flanges which is spaced outwardly from the inner edge of each of said flanges, and said means for maintaining maintains the marginal edge of the top plate in spaced-apart relation to said band portion around the periphery of said marginal edge, whereby said marginal edge is maintained in spaced-apart relation to said band portion of said rim.

7. The improvement of claim 1, wherein said upper flange has a lower surface and a portion of said rim is horizontally spaced outwardly from the marginal edge of the top plate, a portion of each of said wedge members is disposed between the marginal edge of the plate and said portion of said rim to maintain said marginal edge in spaced relation to said portion of said rim, and said means for maintaining maintains the top plate against the lower surface of said upper flange and said wedge members are deformable to enable said members to be positioned between said upper and lower flanges to dispose said portion of said wedges between the marginal edge of the top plate and said portion of said rim and to maintain the top plate against the lower surface of said upper flange with said top plate previously positioned against the lower surface of said upper flange, whereby said wedge members may be placed into said rim with said top plate positioned against the lower surface of said upper flange to maintain the top plate against said upper flange and the marginal edge of the top plate is maintained in spaced relation to said portion of said rim in advance of placement of the top plate on the frame.

8. The improvement of claim 1, further comprising means for releasably fastening said connectors to said frame, said means for releasably fastening being configured together with said connectors to enable said connectors to be released from a nonengaging position whereat said connectors do not engage said wedge members and can be repositioned at an engaging position whereat said connectors will interengage said wedges and said frame, and then refastened to said frame engaging position to interengage said wedge members and said frame.

9. The improvement of claim 8, wherein each of said connectors comprises a forked end and said wedge members are configured to engagingly receive said forked ends of said connectors.

10. The improvement of claim 1, wherein each of said wedge members includes a pair of projections extending from opposite sides of the member and disposed in contact with said lower flange, and each of said connectors comprises a pair of forked members configured to be positioned on said projections so that said forked members of said connectors straddle said wedge members, and said connectors engage said wedge members between said forked members and engage said projections of said wedge members between said forked members and said lower flange.

11. A table assembly comprising a top plate having a marginal edge, a rim bounding the marginal edge of said top plate and having an upper, inwardly extending flange with a lower surface being dimensioned to overlay at least a portion of said top plate and a lower, inwardly extending flange spaced below said top plate and said upper flange, a plurality of wedge members disposed between said upper and lower flanges of said rim and including means for maintaining said top plate against the lower surface of said upper flange, a frame structure including a plurality of leg members with top-supporting sections including means for supporting said top plate on said frame structure, and a plurality of connectors including means for engaging said wedge members and said top-supporting sections of said leg members to prevent relative movement between said wedge members and said top-supporting sections of leg members.

12. The table assembly of claim 10, wherein said top-supporting sections of said leg members are disposed substantially horizontally and each of said sections has a terminating end that is spaced from the terminating end of adjacent sections, said terminating ends being positioned closely adjacent to said rim, said wedge members each being disposed adjacent a terminating end of one of said sections and being fixedly connected to said rim, and said connectors being mounted adjacent said terminating ends of said sections and including means for interacting with said wedge members so that when said connectors engage said wedge members said upper flange engages said top plate causing said top plate to be engaged between said upper flange and said top-supporting sections of said leg members.

* * * * *